United States Patent [19]

Kurdowski et al.

[11] 4,124,378

[45] Nov. 7, 1978

[54] METHOD OF SOLIDIFYING THE SLAG OBTAINED IN FERROCHROMIUM PRODUCTION

[75] Inventors: Wieslaw Kurdowski, Craców; Henryk Makowski, Dabrowa Górnicza; Roman Sobczuk, Crácow; Zenobiusz Szczepanik; Albert Jochelson, both of Wroclaw; Leszek Chomicki, Gliwice; Aleksandra Thiel, Kraków-Nowa Huta; Aleksander Jochelson, Wroclaw; Zygmunt Krupa, Siechnice, all of Poland

[73] Assignee: Huta Siechnice, Siechnica k, Wrockawia, Poland

[21] Appl. No.: 730,252

[22] Filed: Oct. 6, 1976

[51] Int. Cl.[2] ..... C22B 4/00; C22C 33/00; C21C 5/52

[52] U.S. Cl. ..... 75/10 R; 75/11; 75/53; 75/130.5

[58] Field of Search ..... 75/130.5, 53, 94

[56] References Cited

U.S. PATENT DOCUMENTS

| | | | |
|---|---|---|---|
| 2,535,536 | 12/1950 | Hagmaier | 75/94 |
| 3,809,547 | 5/1974 | Lewis | 75/53 |
| 3,827,880 | 8/1974 | Greeson | 75/53 |

*Primary Examiner*—P. D. Rosenberg
*Attorney, Agent, or Firm*—Haseltine, Lake & Waters

[57] ABSTRACT

During ferrochromium production, boron oxide $B_2O_3$ is added to the charge when melting the ferrochromium in the electric furnace. This boron oxide will be added in the form of dried chemical discards resulting from the production of boric acid and/or borax, the said discards containing 2% to 7% of boron oxide.

The boron oxide can also be added in the form of boron ore, advantageously containing more than 30% of boron oxide. The said discards are added in the proportion from 1/20 to 1/50, and preferably 1/30 part by weight of the charge; and moreover, the amount of the lime to be added to the charge will be reduced by the amount of the lime already contained in the added discards as obtained by production of boric acid and/or borax.

The ore is added in the proportion of 1/200 to 1/500, and preferably 1/300 part by weight of the charge.

8 Claims, No Drawings

METHOD OF SOLIDIFYING THE SLAG OBTAINED IN FERROCHROMIUM PRODUCTION

This invention covers a method of solidifying the slag obtained in ferrochromium production.

To date, the slag obtained in ferrochromium production in the amount of about ¾ of the charge, has been drained off into the ladle, where, while cooling down an irregular block of slag is formed. Then, the slag blocks are conveyed to the dump, and stored in the yard. With time, the blocks fall to dust causing air pollution around the works, the fine dust being entrained by wind from the dump and dispersed over the surrounding area.

For example, 1 mill produces 4,000 tons of the dust yearly, and consequently causes dusting of the vicinity which prevents the normal vegetation of plants. The problem can not be solved by partial use of the dust in form of the chromite as the reclaimed quantity is but a few percent and the remaining mass of the slag must be disposed to the dump.

Also other efforts to bind the slag when disintegrated (fallen to dust) by means of cement or other methods, appeared ineffective.

This invention is aimed at permanent binding of the slag obtained in ferrochromium production.

This goal has been attained by adding boron oxide to the charge during the process of ferrochromium production. This boron oxide is added in the form of dried chemical discards as obtained by the production of boric acid and/or borax, and containing from 2% to 7% of boron oxide. The boron oxide can be added in the form of boron ore advantageously containing more than 30% of boron oxide. The discards are added in proportion of 1/20 to 1/50, preferably 1/30 part by weight of the charge, and the amount of lime being added to the charge is reduced by the amount of lime contained in the added discards as obtained by production of boric acid and/or borax. The boron ore is added in proportion from 1/200 to 1/500, and preferably 1/300 part by weight of the charge.

By application of this method, not only the intended goal will be attained viz. binding the ferrochromic slag and solidifying its form, but also the discards as obtained by production of boric acid and/or borax become advantageously utilized. Moreover, the quantity of the lime used for production of the ferrochromium can be economized. With this invention, dusting the vicinity of the ferrochromium works will be prevented. Relevant tests have proved the invention's thorough usefulness: the slag features its permanent form, without the slightest tendency to become disintegrated. The method makes possible the useful utilizing of two waste products, viz. the chemical discards as obtained by production of borax, and the slag from the ferrochromium production process, consumption of the charge material used for production of the ferrochromium i.e. the lime, being reduced at the same time. Moreover, the slag in its permanent (durable) form can be used as a building material.

The following illustrates the method of slag forming according to this invention: the charge used for production of the ferrochromium batch contains 6,000 kg of the chromium ore, 6,000 kg of lime, 1,500 kg of ferrosilicon and 450 kg of dry chemical discards as obtained by production of boric acid and/or borax, and said discards contain about 5% of boron oxide and about 60% of the calcium compound being transferred to the slag during the ferrochromium production process. In the furnace, the standard process of melting the ferrochromium takes place, followed by tapping the slag and the ferrochromium.

When forming the slag using boron ore, the following composition of the charge will be used for example: 6,000 kg of the chromium ore, 6,300 kg of lime, 1,500 kg of ferrosilicon and about 45 kg of the boron ore containing more than 30% of boron oxide.

The invented method requires no changes in the ferrochromium production process, does not call for any modification of the furnace design nor any change in the manner of charging the furnace. Also the slag draining off will be effected identically as to date. By application the the invented method, the basic problem as encountered in the production of ferrochromium, has been eliminated; this problem consisted in how to avoid the disintegration and falling to dust of slag as obtained in the ferrochromium production process and thus causing environmental pollution.

The invented method makes possible thorough utilization of the discards obtained in the production of ferrochromium, as well as those resulting from borax and/or boric acid production, the consumption of lime in the charge being reduced at the same time, and considerable quantities of building materials being obtained.

We claim:

1. In the process for producing ferrochromium by melting a charge comprising chromium ore, lime and ferrosilicon in a furnace thereby forming slag and ferrochromium, draining off the slag and the ferrochromium and allowing the slag to solidify, the improvement consisting of adding boron oxide to the charge whereby the slag when solidified is bound into a mass which does not disintegrate into dust.

2. The improvement of claim 1, wherein the boron oxide is added in the form of the dried chemical discards obtained in the production of boric acid or borax, said discards containing from 2% to 7% of boron oxide.

3. The improvement of claim 1, wherein the boron oxide is added in the form of boron ore containing more than 30% of boron oxide.

4. The improvement of claim 2, wherein said discards are added in the amount of 1/20 to 1/50 part by weight of the charge, and the amount of the lime added to the charge is reduced by the amount of lime contained in the discards.

5. The improvement of claim 3, wherein the boron ore is added in the proportion of 1/200 to 1/500 part by weight of the charge.

6. The improvement of claim 4 wherein the discards are added in the amount of 1/30 part by weight of the charge.

7. The improvement of claim 5 wherein the boron ore is added in the amount of 1/300 part by weight of the charge.

8. The product obtained by the process of claim 1.

* * * * *